US006164568A

United States Patent [19]

Muller et al.

[11] Patent Number: 6,164,568

[45] Date of Patent: Dec. 26, 2000

[54] DEVICE FOR APPLYING FREE-FLOWING MATERIAL TO A SUBSTRATE, IN PARTICULAR FOR INTERMITTENT APPLICATION OF LIQUID ADHESIVE

[75] Inventors: Manfred Muller, Ulzen; Andrew Grummt, Winsen/Luhe; Thomas Burmester, Bleckede; Hans-Joachim Seedorf, Scharnebeck; Gunther Burmester, Hohnstorf; Hubert Kufner, Markgröningen; Ernst Hering, Barnstedt; Andreas Bornkebel, Adendorf; Donald Lohse, Lüneburg, all of Germany

[73] Assignee: Nordson Corporation, Westlake, Ohio

[21] Appl. No.: 08/996,390

[22] Filed: Dec. 22, 1997

[30] Foreign Application Priority Data

Dec. 23, 1996 [DE] Germany ..... 296 22 341

[51] Int. Cl.[7] ..... B05B 1/30

[52] U.S. Cl. ..... 239/586; 239/584

[58] Field of Search ..... 239/586, 584, 239/583, 569; 251/63.5, 324, 318, 333

[56] References Cited

U.S. PATENT DOCUMENTS

| | | | |
|---|---|---|---|
| 2,766,484 | 10/1956 | Sanderson | 18/30 |
| 3,854,631 | 12/1974 | Moen | 222/146 |
| 4,484,711 | 11/1984 | Constatinescu et al. | 239/586 X |
| 4,678,100 | 7/1987 | Gelinas et al. | 222/52 |
| 4,687,137 | 8/1987 | Boger et al. | 239/124 |
| 4,989,792 | 2/1991 | Claassen | 239/586 |
| 5,022,358 | 6/1991 | Richeson | 251/63.5 X |
| 5,056,687 | 10/1991 | Claassen | 239/583 X |
| 5,094,399 | 3/1992 | Zaber | 239/583 X |
| 5,277,342 | 1/1994 | Dickau et al. | 222/87 |

FOREIGN PATENT DOCUMENTS

| | | |
|---|---|---|
| 0329829 | 8/1989 | European Pat. Off. . |
| 0565972 | 10/1993 | European Pat. Off. . |
| 0668111 | 8/1995 | European Pat. Off. . |
| 0676248 | 10/1995 | European Pat. Off. . |
| 0681874 | 11/1995 | European Pat. Off. . |
| 29613761 | 12/1996 | Germany . |

*Primary Examiner*—Andres Kashinkow
*Assistant Examiner*—Sean P. O'Hanlon
*Attorney, Agent, or Firm*—Wood, Herron & Evans, L.L.P.

[57] ABSTRACT

A device for applying free-flowing material to a movable substrate (1), especially for intermittent application of liquid adhesive. At least one supply channel (46) feeds free-flowing material and at least one nozzle unit (8) with at least one output channel is connected with the supply channel (46) and ends in an output orifice for delivering material. A valve mechanism interrupts the flow of material and includes a movable valve body (14) and a valve seat (44). The valve body (14) interacts with the valve seat (44) in such a way that the flow of material is interrupted by movement of the valve body (14) to a closed position and released by movement into an open position. The valve body (14) comes into contact with the valve seat (44) to interrupt the flow of material through a movement contrary to the direction of flow of the material.

7 Claims, 8 Drawing Sheets

DEVICE FOR APPLYING FREE-FLOWING MATERIAL TO A SUBSTRATE, IN PARTICULAR FOR INTERMITTENT APPLICATION OF LIQUID ADHESIVE

BACKGROUND OF THE INVENTION

The present invention pertains to a device for applying free-flowing material to a movable substrate in particular for intermittent application of liquid adhesive, with at least one supply channel for supplying flowing material, at least one nozzle unit with at least one output channel, connected to the supply channel and ending in an output orifice for delivering material, and with a valve mechanism for interrupting the flow of material, having a movable valve body and a valve seat, where the valve body and the valve seat interact in such a way that the flow of material is interrupted by movement of the valve body to a closed position and is released by movement to an open position.

In industry a device of this type is used, for example, in order to coat the surfaces of film-type substrates with liquid adhesive, such as hot-melt glue. Often so-called intermittent application is used, meaning that intervals in which the valve body is in the open position and material is applied to the substrate alternate with intervals in which the valve body is in the closed position, so that the application of material is interrupted. Where application is intermittent, often very short intervals are used, in order to be able to realize application zones at very close intervals to each other. In some uses the flow of material needs to be interrupted up to 1000 times per minute.

The requirement for the pattern which takes shape on the substrate is that a zone where material is applied to the substrate must have sharply defined boundaries. In the case of application to an area with the help of a known slotted nozzle arrangement it is especially desired that the lateral margins—in the direction of movement of the substrate relative to the application device—, but also the leading and trailing boundaries of a zone where material is applied, be sharply delimited. Prerequisite for such sharp delimitation of the leading and trailing boundaries is that the body of the valve be moved quickly into its closed position, so that the flow of material from the output orifice is interrupted uniformly quickly. When the valve is opened, in order to achieve a sharp definition line at the leading boundary of an application zone it is necessary for the valve to open quickly.

In the current state of technology a so-called needle valve is used; as its valve body it has a needle with a needle point which can be brought into contact with a valve seat which matches the shape of the needle point. To close the valve, the needle is moved—by an electrical-pneumatic mechanism—in the direction of the valve seat and comes into contact with the latter, so that the flow section of the supply channel is closed and the flow of material is thereby interrupted. During the closing movement of the needle point the latter is moved in the direction of flow, toward the substrate. During the closing movement of the needle point adhesive is forced downstream by the needle point in the direction of the output orifices. This has the effect that until the needle point comes into contact with the valve seat, material is forced in the direction of the output orifice. As a consequence, the application of material to the substrate is not interrupted as abruptly as would be necessary to produce a sharp line of demarcation in the end area of an application zone. "Afterdripping" from the output orifice when the valve is closed cannot be prevented.

SUMMARY OF THE INVENTION

Underlying the present invention is the task of indicating a device of the type mentioned at the beginning, with which afterdripping can largely be avoided and sharply delimited material application zones can be produced on a substrate.

The problem is solved with a device of the type mentioned at the beginning, by having the valve body come into contact with the valve seat by moving contrary to the flow direction of the material in order to interrupt the flow of material.

Through the invention an abrupt interruption of the flow of material is achieved, and unwanted "afterdripping" when the material flow is interrupted is largely prevented by means of the valve mechanism, so that application zones with sharply defined boundaries can be realized when material is applied to a substrate. For example, under the invention, when adhesive is applied to areas of a film by means of a slotted nozzle arrangement in the direction of motion of the substrate, a straight, "sharp" trailing boundary line is achieved.

By means of the upstream movement of the valve body against the direction of flow when the valve is open, in accordance with the invention, no material is pressed in the direction of the output orifice during the closing movement of the valve body. Rather, on the contrary, material is even moved upstream along with the valve body against the usual direction of flow, through the effects of suction and adhesion. In this way, the delivery of material from the output orifice is interrupted abruptly during the closing movement. The result is a sharp demarcation line at the rear boundary of the application zone.

To open the valve, under the invention the valve body is moved "downstream" so that the valve body comes away from the seat. During this movement, material which is located ahead of the valve body in the direction of flow is moved toward the output orifices of the nozzle, so that nearly simultaneously with the beginning of the movement of the valve body from the closed position to the open position material is transported in the direction of the output orifice, because the valve body pushes the material in this direction. In this way a sharp line of demarcation at the leading boundary of the application zone can be realized, because the application of material begins almost immediately after the movement of the valve body begins. The pattern of application on the substrate can be improved significantly by the invention. Through the invention, "afterdripping" can largely be avoided.

According to an especially preferred variant of the invention, the valve body is attached to a shaft segment and has an enlarged cross section relative to the shaft. This is a simple way to construct a valve mechanism in accordance with the invention. In this version the shaft segment is positioned so that it can move within a segment of the supply channel whose diameter is larger than that of the shaft, and the valve body can also be moved between its open and closed positions by a simple design. In a refinement of the invention, the valve body has essentially the shape of a ball.

In accordance with a preferred version of the invention, the valve body has a section with essentially the shape of a truncated cone which can be brought into contact with the valve seat. In this way material which is in the supply channel is moved upstream especially effectively, since a displacement effect of the valve body—in this case the truncated conical section—occurs, which moves the material upstream.

In accordance with a further advancement of this version, attached to the section with the truncated cone the valve body has a section which is essentially in the shape of a disk. This further increases the volume and hence the displacement effect of the valve body. This effect is also achieved in a refinement where the valve body has an additional section shaped essentially like a truncated cone, adjacent to the disk-shaped section. This gives the valve body advantageous flow characteristics, since during the closing movement its shape forces material upstream and during the opening movement the material is forced downstream, so that the effect of the invention is amplified.

An especially preferred version of the invention is distinguished by the fact that the shaft segment is attached to a differential pressure piston, to both sides of which air pressure can be applied, so that the piston and the valve body can be moved in coordination through the application of pressure. With the help of this sort of differential pressure piston, high-speed alternating movement of the valve body from the open to the closed position and vice versa can be achieved, which makes it possible to realize extremely short phases of interruption in material flow and application.

In accordance with a refinement of this version, the piston has two opposing effective surfaces of different sizes, to each of which air pressure can be applied independently. Because of the different sizes of the effective surfaces a greater force can be applied to close the piston, or optionally to open it. The piston is arranged advantageously in such a way that it moves the valve body into the open position by means of a force produced on the larger effective surface. For example, the larger effective surface is located on the side of the pressure piston away from the valve body, so that a greater force can be applied to open the valve.

It is useful to also provide a spring which works together with the differential pressure piston; its spring force, operating on the piston, pre-tensions the valve body in the direction of the closed position. The spring is arranged in such a way that if the supply of pressurized air fails the valve body is moved to the closed position by the spring.

The device can be further optimized in terms of flow technology through an alternative version by having the valve body essentially in a cylindrical cavity when in the open position. The displacement effect described earlier to achieve an abrupt interruption of the flow of material can thereby be further improved.

According to an additional aspect of the invention, using a device of the type mentioned at the beginning in which the bottom of the nozzle has an external contact area in the vicinity of the output orifice which, during the application of material, comes partly in contact with the substrate, which is moving relative to the output orifice, the problem is solved by letting the external contact area have a curved segment which diverges relative to the substrate.

A device of this sort ensures that a substrate which is touching the contact area is always guided optimally relative to the output orifice of the nozzle. Especially in the case where a flexible, film-like substrate is to be coated with material in areas with the help of a slotted nozzle, an optimal orientation of the substrate relative to the output orifice is always realized. In this case it regularly happens that the film-like substrate is pressed against the contact area of the nozzle with a (slight) pressure by means of rollers. Here the substrate is not precisely in a flat plane, but can follow a slightly curved path. With the devices which are known under the current state of technology, which have an essentially straight contact section, a curved path of this sort can result in the accumulation of material between the nozzle orifice and the substrate. And if the flow in intermittent operation is constantly being stopped and restarted, the accumulations of material can lead to imprecise demarcation lines on the application zones on the substrate. By means of the curved section of the external contact area, which diverges relative to the substrate, a moving film is guided precisely to the output orifice. Spaces in which unwanted material could accumulate are avoided by the invention. In addition, damage to the film-like substrate can be avoided by the curved path.

According to an especially preferred version of the invention in accordance with this aspect, the contact area extends, starting from the output orifice, toward the direction of movement of the substrate. In the area of approach of a film in the direction of movement before the output orifice, guiding of the film as described earlier is thereby achieved.

According to a refinement of the invention, the curved section has a cross section which is part of a circle. This permits favorable guiding with a simple design.

The application performance can be further optimized, in accordance with an additional preferred version, by having a break-off edge close after the output orifice in the direction in which the substrate is moving, at which point the moving substrate ceases to touch the contact section. This can prevent the accumulation of material between the substrate—in the form of a film—and the bottom section of the nozzle, which would prevent clean, sharply defined application of adhesive.

The effects of the invention become especially clear with a further refinement of the invention, when the nozzle arrangement takes the form of a slotted nozzle, where the supply channel for the material ends in a distribution channel, with at least one output channel attached on the downstream side with a slit-shaped output orifice.

There are manufacturing advantages in an alternative version in which the nozzle consists substantially of a mouthpiece holder and an attached mouthpiece which has the bottom contact area.

This version is further refined advantageously by having a straight passage hole drilled in the mouthpiece holder as a channel for delivering material to the distribution channel, which is fed with material by the supply channel and whose lower output orifice ends in the distribution channel. It is especially advantageous in terms of flow technology for the drilled hole to be canted from the vertical axis. This makes it possible to avoid complicated systems of drilled holes within the nozzle—as are frequently present with current technology—where there are frequently blind holes within the mouthpiece holder in which there are "dead spaces" in terms of the flow of the material, which work against clean application of adhesive, especially in intermittent operation. The reason is that because of the canted orientation of the drilled hole the distance of flow in the mouthpiece holder is minimized. Thus there is a minimal volume of material present during the pressure variations in intermittent operation, to be compressed and expanded due to these pressure variations, which leads to non-abrupt interruption of the application. By minimizing the flow distances this detrimental effect can be reduced.

According to an additional aspect of the invention the problem is solved by a device of the type mentioned at the beginning, with at least two supply channels feeding a common nozzle and at least two valves, each located in a supply channel and controllable by means of a controlling device, by having the valve mechanisms controllable in such a way that in one operating state both valves open the supply channel simultaneously for an application of material, and in a second operating state the valves alternately open or close the respective supply channels.

With a control system of this sort, according to the invention, in the first operating state an application of material can be made on the substrate with a certain thickness when both valves open the supply channel simultaneously, so that material from two sources is applied. In a second operating state the valves are opened alternately, so that the shared nozzle is fed alternately by the two supply channels, so that the phases of application by delivery of material through the output orifices and the phases of interruption of delivery of material can be kept very short. In an advantageous manner the valves are further controllable in such a way that in a third operating state one valve opens its associated supply channel and the other valve intermittently opens and closes its associated supply channel.

If, in accordance with a preferred version of the invention, the supply channels are connected to and fed from different sources of material, these differing materials can be mixed together inside the nozzle and then applied to the substrate.

In the following section the invention is described on the basis of a number of variant examples of the device covered by the invention, with reference to the accompanying drawings. The figures show the following:

DETAILED DESCRIPTION OF THE PREFERRED EMBODIMENTS

Figure 1:
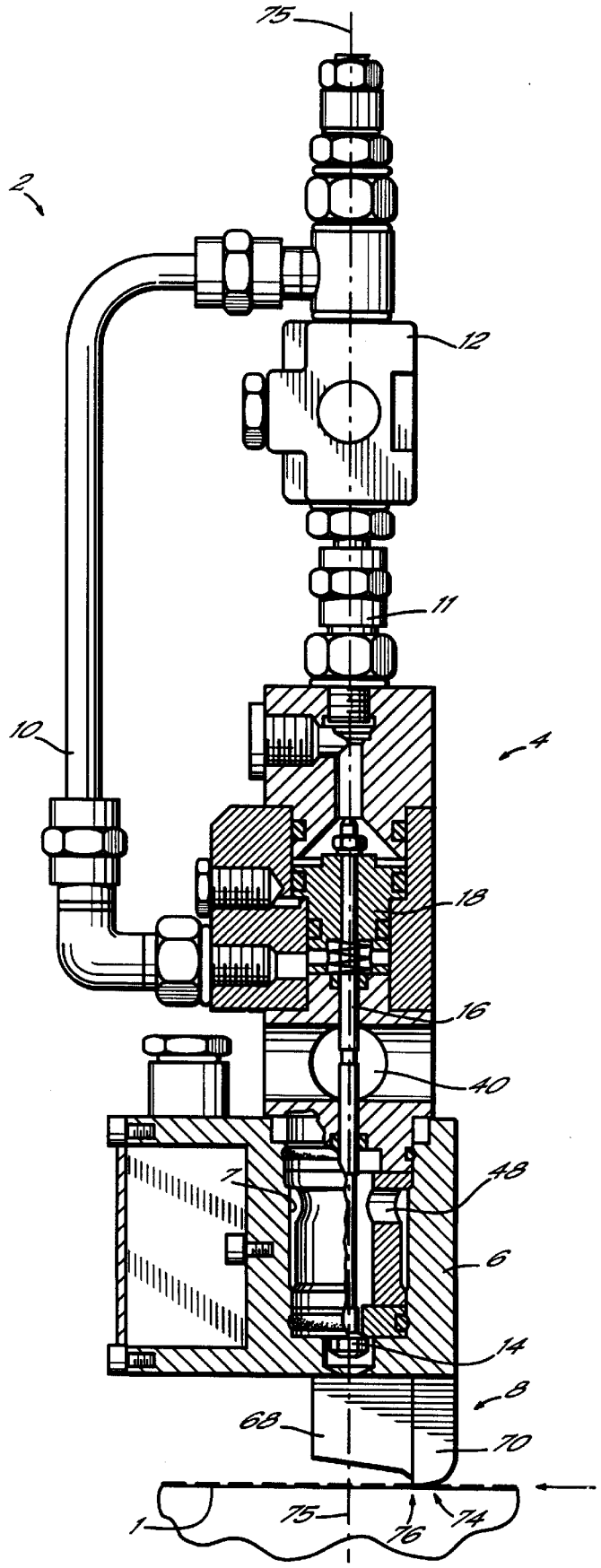
FIG. 1: A device in accordance with the invention, for applying liquid adhesive to a substrate, with an application head, in a partial cutaway illustration.

The device shown in FIG. 1, for applying liquid adhesive to a substrate 1 which can be moved in the direction shown by the arrow, has an application head 2. The upper part of the application head 2 includes a control unit 4 with electrical-pneumatic activation (see FIG. 4) which is mounted on the base piece 6. A nozzle unit 8 is mounted on the bottom of the base 6. The base 6 in turn is mounted on a stationary carrier which is not shown. The control unit 4 is connected by means of two pressurized air lines 10, 11 to a source of pressurized air, not shown, which supplies a pressure of about 6 bar. By means of a solenoid valve 12 pressurized air can be applied to the control unit 4. The base piece 6 has a drilled hole 7 into which a lower section of the control unit 4 is inserted. In the upper part of the control unit 4 (FIG. 4) there are two connecting holes 21, 23, which can optionally be joined by a pressurized air line. In the sample version shown in FIG. 4 the hole 23 is closed with a plug 25.

Figure 2:
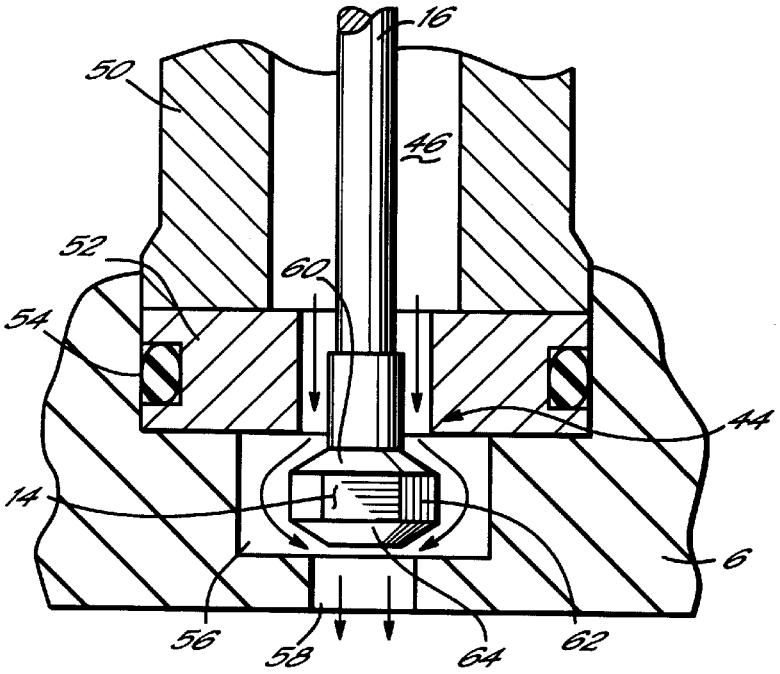
FIG. 2: A cross-section of part of a valve from FIG. 1 in open position.
Figure 3:
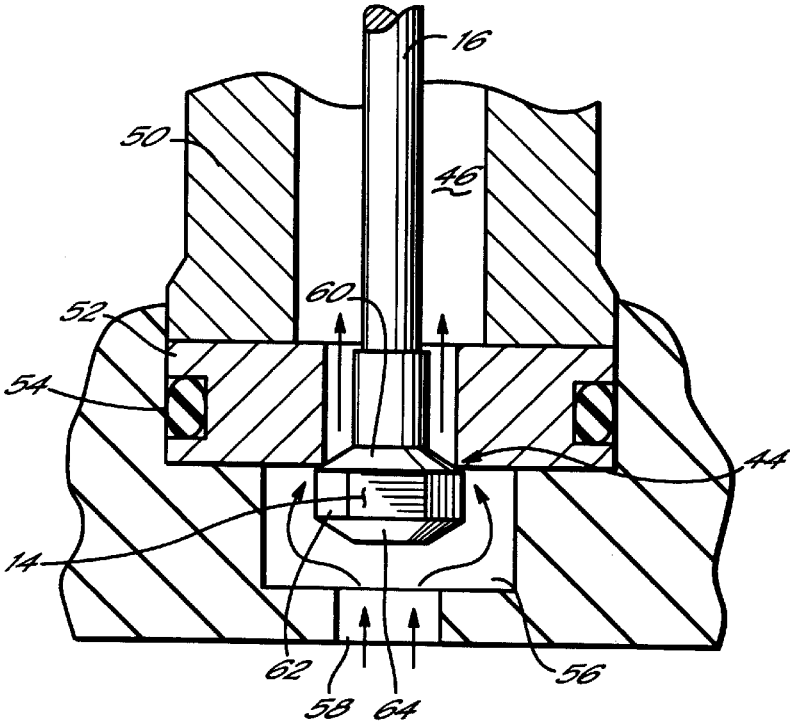
FIG. 3: The section shown in FIG. 2, in closed position.
Figure 4:
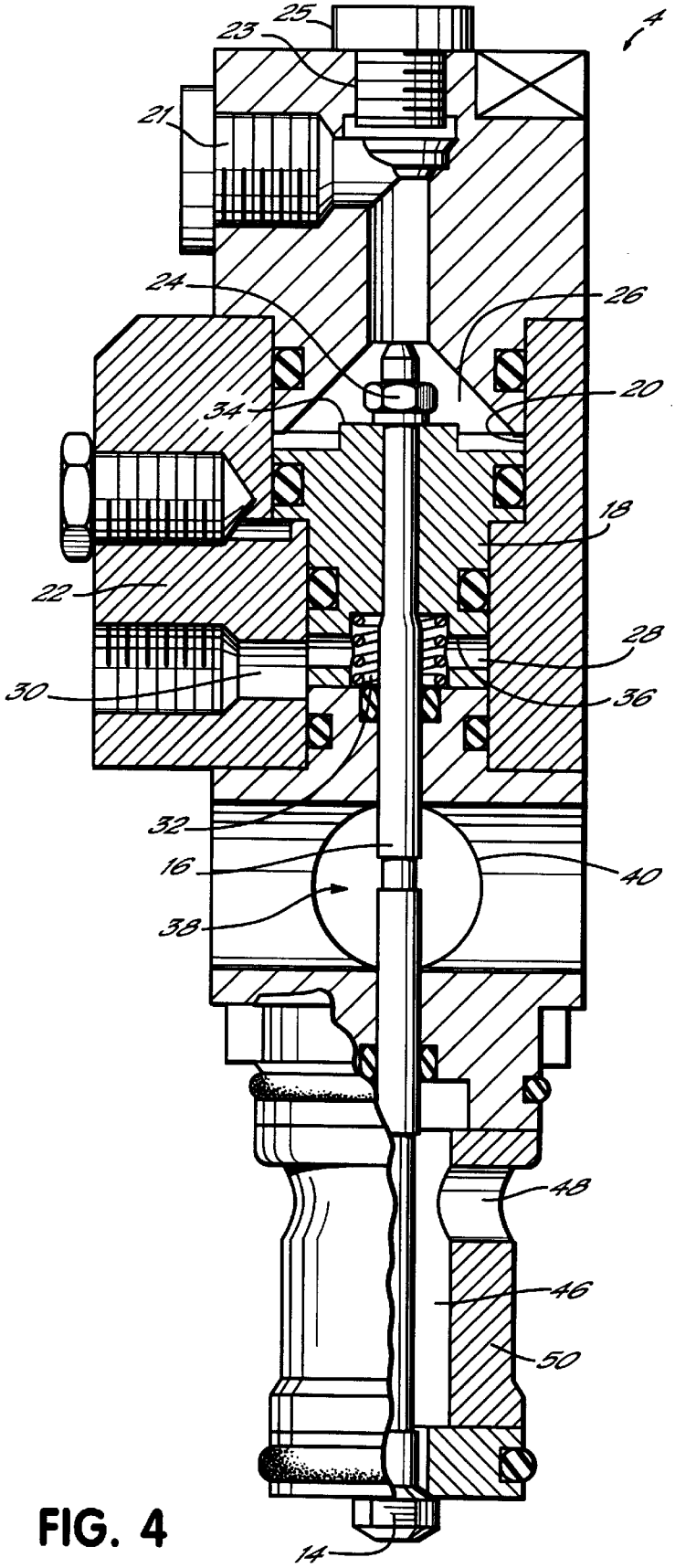
FIG. 4: A control unit for the device shown in FIG. 1, in a cutaway illustration.

The control unit 4, which is shown enlarged in FIG. 4, has a valve mechanism, partly shown in FIGS. 2 and 3, for regulating the quantity of adhesive which is delivered by the nozzle unit 8 and is to be applied to the substrate 1; the purpose of the valve is to interrupt and release the flow of adhesive. The essentials of the valve mechanism are a valve body 14, a rod-shaped shaft segment 16, and a valve seat 44. The valve body 14 interacts with the valve seat 44 in such a way that the flow of material is interrupted by movement of the valve body 14 into a closed position and released by movement to an open position. The valve body 14 comes into contact with the valve seat through movement counter to the direction of flow of the material, in order to interrupt the flow of material.

A differential pressure piston 18 is attached to the upper movable segment of the shaft 16. The piston 18 is positioned in a bore 20 in a base 22 and can move axially. The piston 18 has a central bore in which a portion of the shaft segment 16 is positioned. A nut 24 is screwed onto male threads on the end of the shaft segment 16, securing the piston 18 to the shaft segment 16.

Above the piston 18 there is a chamber 26 which can be filled with gas and have gas pressure applied. This makes it possible to apply force to the piston 18. Below the piston 18 is an additional chamber 28 which can be filled with gas, inside the bore 20 in the base 22; it can have air pressure applied by means of a connecting channel 30 with the pressurized air line 10. The piston 18 has an upper effective surface 34, which is larger than a lower effective surface 36, so that when the pressure is the same in the chambers 26 and 28 the resulting forces operating on the piston 18 will be of different magnitudes. With the pressures the same the piston would be pressed toward the nozzle 8—in FIG. 4 it is pressed downward—so that the valve body 14 is pushed to its open position. The piston 18 is sealed against the base 22 by means of O rings in a manner which is not described in further detail.

In the chamber 28, concentric to the essentially cylindrical shaft segment 16, there is a helical spring 32, whose spring force operates on the piston 18 and pre-tensions it in the closed position of the valve—in FIG. 4 it pushes upward.

To open the valve and thereby release the flow of adhesive, in the example version the solenoid valve 12 (FIG. 1) is opened. That creates pressure in the chamber 26, corresponding approximately to the pressure of the pressurized air source and acting on the effective surface 34. In the chamber 28 the pressure of the pressurized air source is constant. Since the effective surface 34 is greater than the effective surface 36, the piston 18 is moved in the direction toward the substrate 1. To close the valve mechanism and thereby interrupt the flow of adhesive, the solenoid valve 12 is switched in such a way that the pressure in the chamber 26 is reduced. For this purpose pressurized air is vented from the solenoid valve 12 to the environment. This reduction of pressure in the chamber 26 causes the piston 18 to be pushed "upward" by the resulting force operating on the effective surface 36, and the valve body 14 is moved in an upward, upstream direction to the closed position. This is supported by the spring force of the spring 32.

As can be seen best from FIG. 4, the shaft segment 16 of the valve 14 is marked with a notch 38 which is visible from outside through a viewing window 40 in the control unit 4, so that the position of the movable valve body 14 which is attached to the shaft segment 16 can be recognized from outside.

To supply adhesive to the nozzle unit 8, from which the adhesive is emitted and applied to the substrate 1, in a lower section of the control unit 4 there is an adhesive supply channel 46 which can be fed adhesive from an adhesive source. The supply channel 46 is essentially a cylindrical bore within a (ring) body 50. At the lower end of the body there is a ring 52 attached; it too has a central passage hole which is part of the supply channel 46.

The valve seat 44 is formed on the ring 52; it is shown in FIGS. 2 and 3 as a ring-shaped rim. The valve seat 44 can be adapted to the shape of the valve body 14. It can be ground and hardened. The ring 52 is sealed relative to the base 6 by means of an O ring 54. As can be seen from FIGS. 2 and 3, the valve body 14 is positioned inside an essentially cylindrical chamber 56 in the base 6. Connected to the chamber 56 in the direction of flow there is a passage 58 through which the adhesive can flow into the nozzle unit.

The valve body 14, which forms a single unit with the shaft segment 16, is rotationally symmetrical, just as the shaft segment is, and has a distal end section 60 in the form of a truncated cone connected to the shaft segment 16; it makes contact with the valve seat 44 in the closed position, as shown in FIG. 3. Joined to the section 60 on the downstream side is an essentially disk-shaped section 62, which further downstream again passes over into a truncated conical section 64 which marks the bottom end of the valve body 14. Starting from the shaft segment 16 the body 14 has a cross section which first widens, then a section which remains constant, and further downstreamn a section which grows narrower. It has an outside diameter which is larger than the inside diameter of the supply channel 46, so that when the shaft segment 16 moves in combination with the valve body 14 the latter comes to rest against the valve seat 44. The diameter of the shaft segment 16 is smaller than that of the supply channel 46, so that a ring channel is formed between the two.

As an alternative, the valve body 14 can be designed essentially as a ball or a round disk, which is fastened to the shaft section 16 or preferably forms a unit with it.

Figure 9:
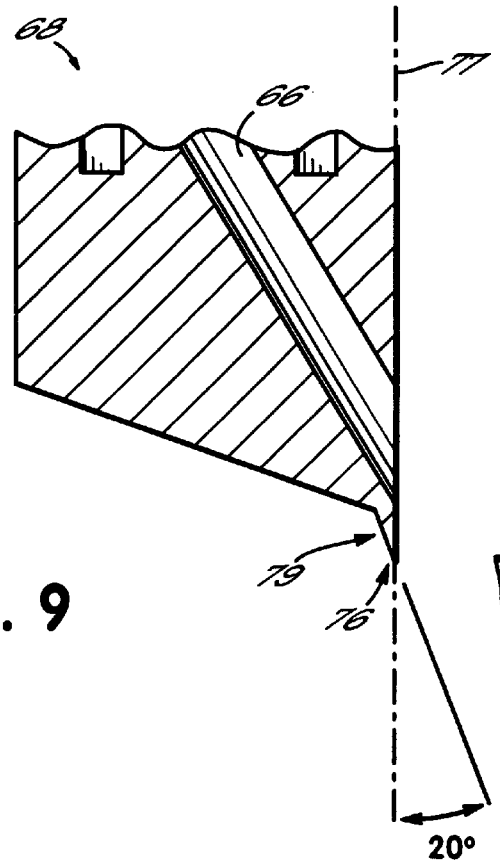
FIG. 9: A mouthpiece holder for a nozzle system for a device in accordance with the invention, in cross section.

The passage 58 opens into a duct 66 inside the nozzle 8, which is in the form of a slotted nozzle; the duct 66 (FIG. 9) is formed as a straight passage hole in a mouthpiece holder 68 shown in FIG. 9. In FIG. 9 the duct 66 is oriented obliquely to a vertical axis. Mounted on the mouthpiece holder 68 is a mouthpiece 70, as can be seen from FIG. 1; it is shown separately in FIG. 10 and is screwed to the mouthpiece holder 68 by means of a bolt in a hole 71. In the installed state shown in FIG. 1, an elliptical lower opening of the diagonally running duct 66 opens into a distribution channel 72 which is in horizontal position in operation, in which the glue is conducted to a number of output channels which are not shown, and which are formed in a known manner by means of a spacer sheet positioned between the mouthpiece holder 66 and the mouthpiece 70. The output channels are in the form of elongated slits, and open at a lower end of the nozzle unit 8 (FIG. 1) into slit-shaped output orifices from which material can be delivered.

Close to the output orifices the nozzle unit 8 has an external contact area 74 located on the mouthpiece 70 which during the application process is at least partly in contact with the substrate which is moving relative to the output orifice. The contact area 74 has a section which is curved and diverges relative to the substrate 1, as can be seen from FIGS. 1 and 10. It extends out, starting from an output orifice, against the direction of movement of the substrate—to the left in FIG. 1—and its cross section (FIG. 10) has the shape of part of a circle. In FIG. 1 the substrate is shown as flat and lying against the contact area 74, but it can have a slightly curved path, for example when it is in the form of film guided by rollers.

Figure 10:
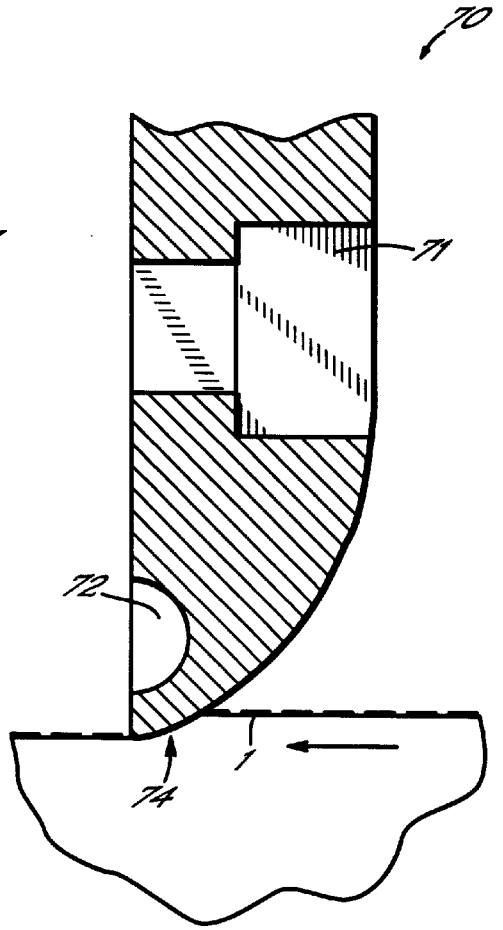
FIG. 10: A mouthpiece for a valve mechanism for a device in accordance with the invention, in cross section.

The moving substrate 1 is guided by the curved section of the contact area 74 to the output orifice—or multiple output orifices in a row—of the slotted nozzle unit, as indicated in FIG. 10 by a dashed line. If the output orifice of the nozzle unit is not oriented precisely relative to the substrate 1 during operation, for example because the substrate is not guided precisely by a guiding system to a desired path or because the entire application 2 is not located exactly in the desired position on the carrier, then the substrate is also guided to the output orifice by the contact section. Tests have shown, for example, that in a case where the substrate 1 is in an essentially horizontal orientation, and relative to this an application head axis 75 which is positioned parallel to an output channel in the nozzle unit is tilted by up to about 20% from the vertical, good application of adhesive can still be realized, since the substrate is guided in this case by the contact area 74 in such a way that clean application of adhesive can be realized.

Behind an output orifice in the direction of movement of the substrate 1, the nozzle unit 8 has a break-off edge 76 located on the mouthpiece holder 68. Behind the break-off edge in the direction of movement of the substrate there is a rim 79 of the mouthpiece holder 68 at an acute angle to an axis 77 (and hence to a vertical axis in the figures). In the example version shown in FIG. 9 the angle between the rim 79 and the axis 77 is about 20°.

Figure 5:
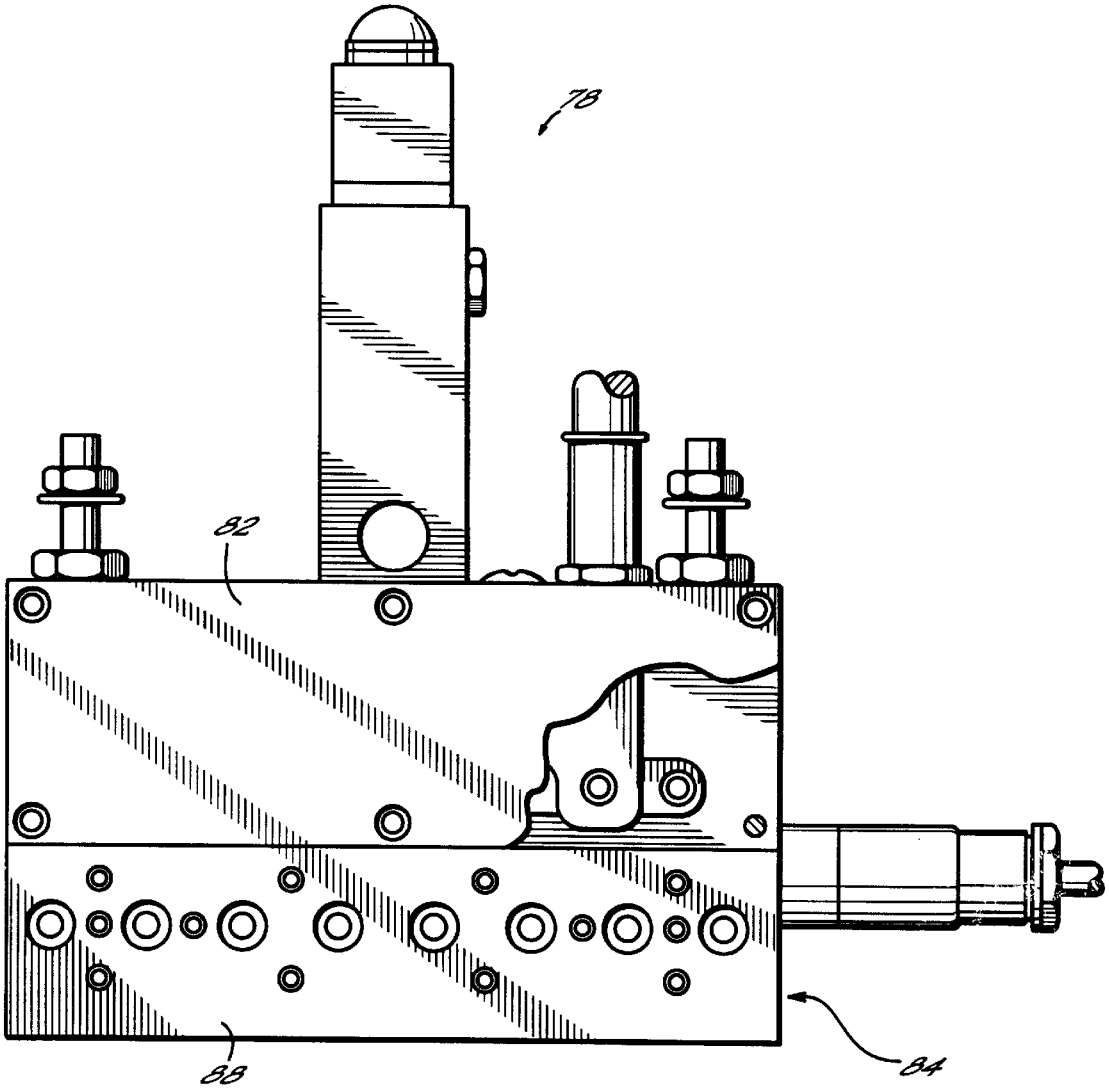
FIG. 5: A side view of an alternative version of a device in accordance with the invention, for applying adhesive with two application heads and two valve systems.
Figure 6:
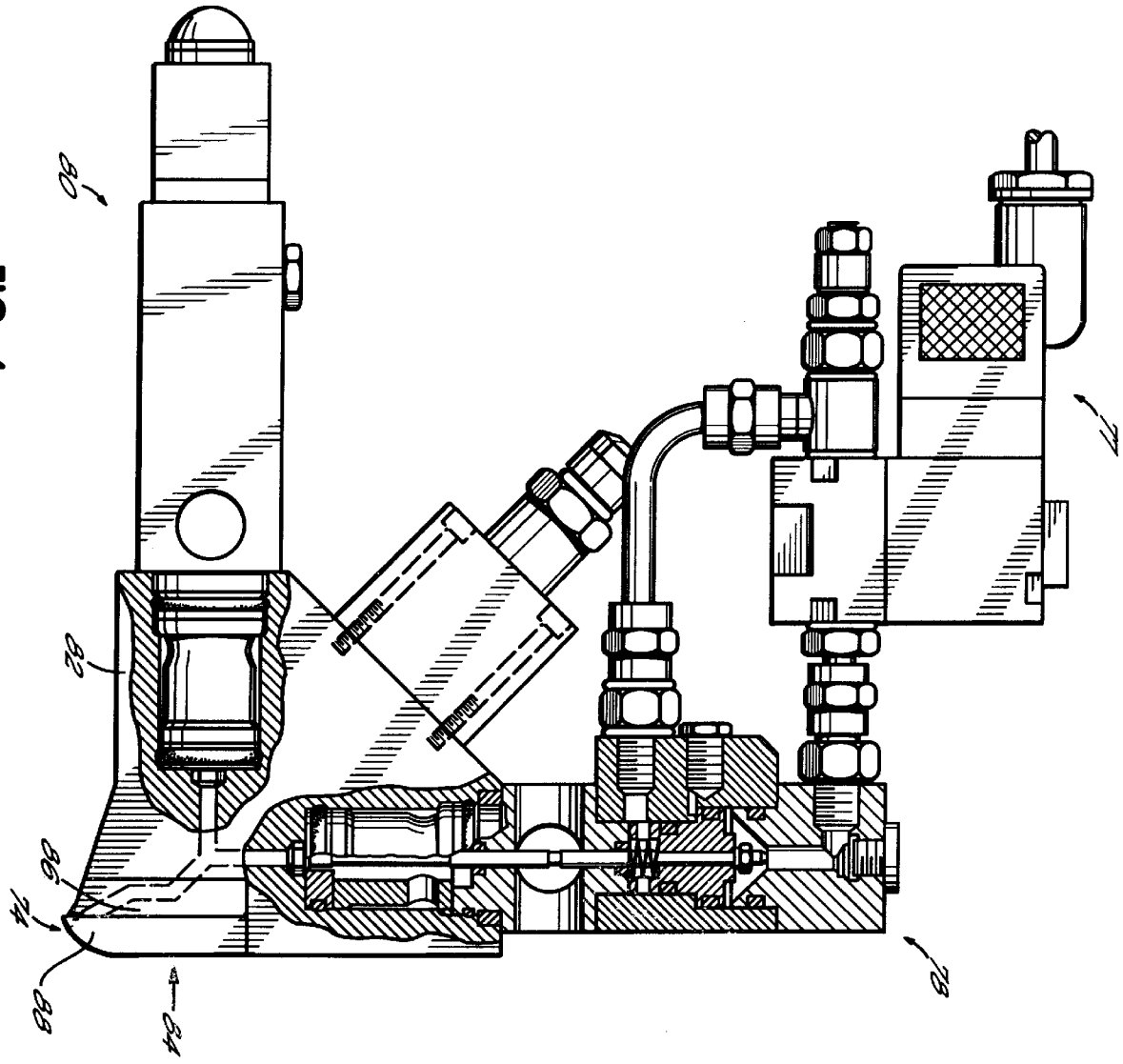
FIG. 6: A partial cutaway illustration of the device from FIG. 5.

FIGS. 5 and 6 show an alternative example version of a device for applying free-flowing material in accordance with the invention, in which two application heads 78, 80 described earlier on the basis of FIGS. 1 to 4 are attached to a base 82 and are essentially at right angles to each other. The device thus has two supply channels which supply a shared nozzle 84 with adhesive. The two valve units for the application heads 78 and 80 can be controlled electrically-pneumatically by means of a control unit 77. The nozzle unit 84 has a mouthpiece holder 86 and a mouthpiece 88 attached to it, as described earlier on the basis of FIGS. 9 and 10. The mouthpiece 88 has a curved contact area 74, which comes at least partly in contact with a substrate.

The two valve mechanisms of the application heads 78, 80 are controllable in such a way that in a first operating state both valve mechanisms simultaneously open the supply channel 46 for a flow of material; in a second operating state the valve units alternately open and close their respective supply channels 46. In this manner it is possible to realize either alternating intermittent operation of the two application heads 78, 80 or a simultaneous flow of material through the two application heads 78, 80. If the two supply channels 46 are fed from different sources of material (not shown), then during the first operating state the two materials coming from the different material sources can be mixed together and applied to a substrate, or in the second operating state the differing materials can be applied alternately.

Figure 7:
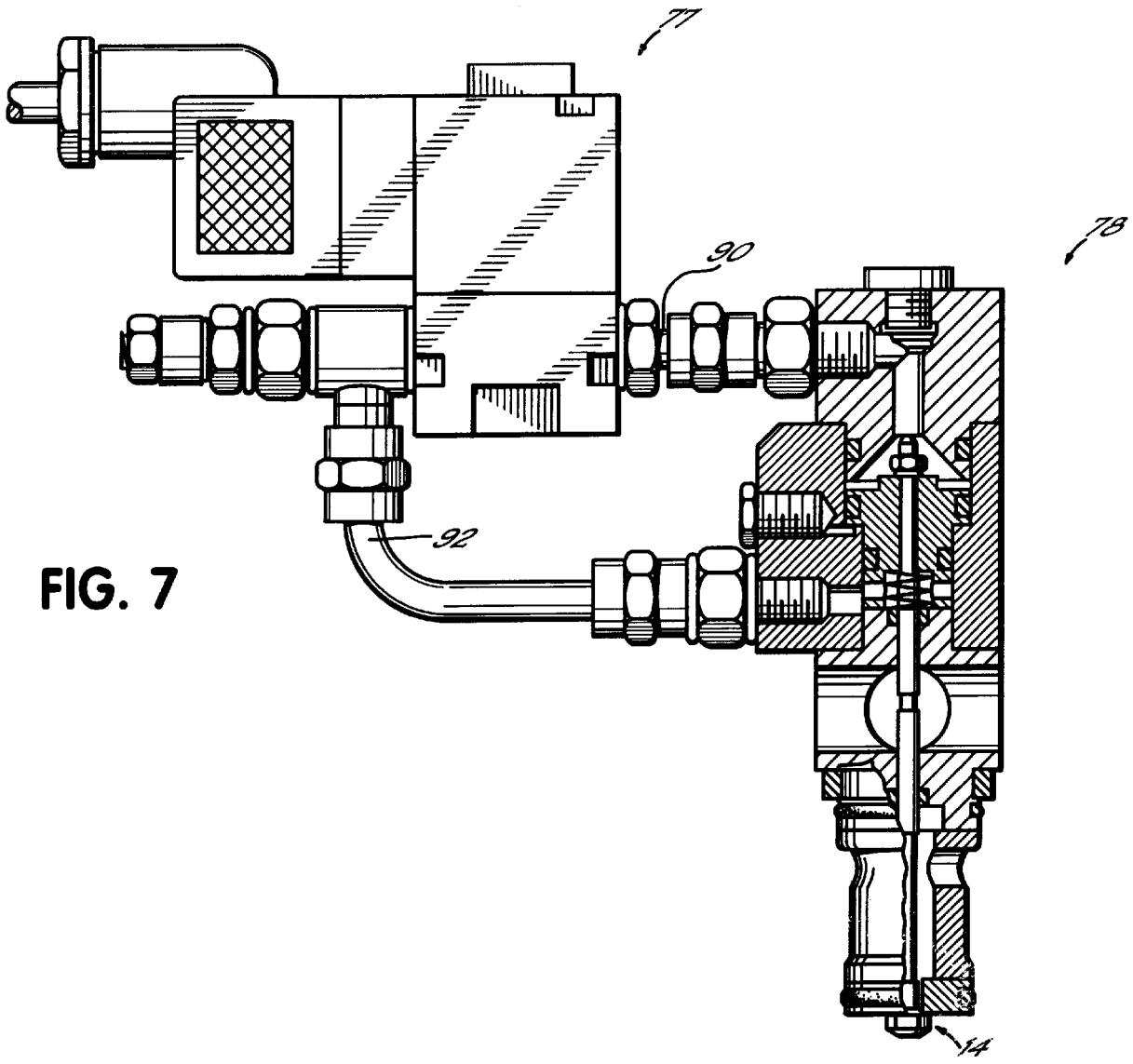
FIG. 7: An enlarged depiction of an application head for the device shown in FIGS. 5 and 6.

FIG. 7 shows a part of the application head 78 and the control unit 77, as well as pressurized air lines 90, 92 through which air pressure can be applied by the control unit to move the valve body 14.

Figure 8:
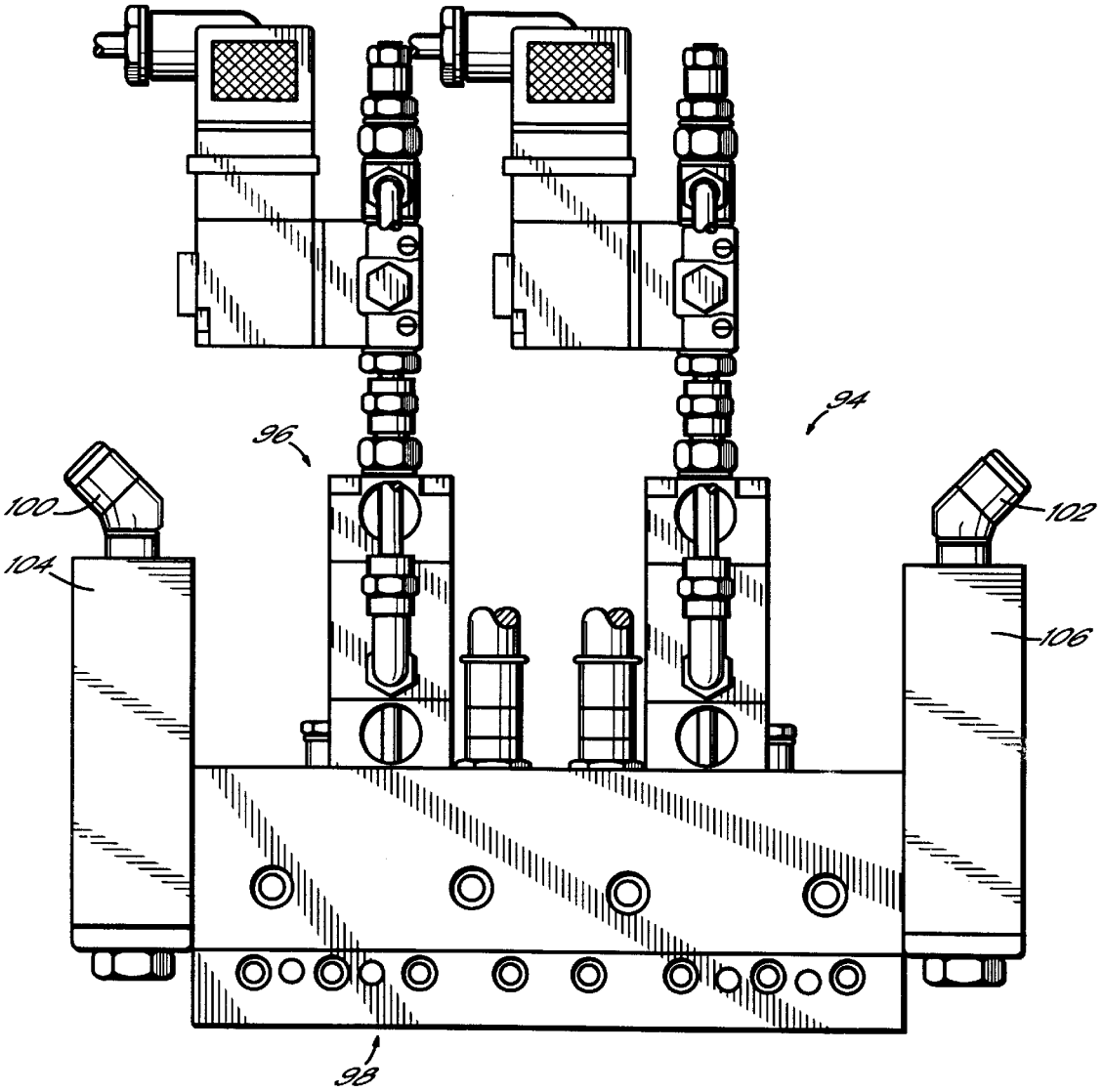
FIG. 8: An alternative version of a device in accordance with the invention for applying adhesive, with two application heads and two valve mechanisms.

FIG. 8 shows an additional, alternative example version of a device for applying free-flowing material with two application heads 94, 96, which are arranged parallel to each other and feed a slotted nozzle unit 98 with material. The application heads 94, 96 in this device are essentially identical in form to the application head 2 described on the basis of FIGS. 1–4, and can be controlled in the same way as the device described earlier on the basis of FIGS. 5–7, so that we refer here to the description above. By means of two connections 100, 102 and two adhesive filters 104, 106 the adhesive is conducted to two connections 48 in the control unit 4 (see FIG. 4). The flows of adhesive can be controlled independently of each other in the manner described earlier, by means of two individually controllable valve units for the application heads 94, 96, and feed the shared slotted nozzle unit 98.

The next section describes the manner of operation of the devices described above:

From one or more sources of adhesive, liquid adhesive or another free-flowing material is conveyed by means of supply lines (not shown) into an application head 2, 78, 80, 94, 96 and into the supply channel 46 (FIGS. 2 to 4) of a control unit 4. In the open position of the valve body 4 (FIG. 2) the material flows through the passage formed between the section 60 in the form of a truncated cone and the valve seat 44, into the cylindrical chamber 56 and on through the passage 58 into the nozzle 8; there it flows through the duct 66 which is drilled obliquely in the mouthpiece holder 68, into the essentially horizontal distribution channel 72 into the mouthpiece 70. The material is divided in the distribution channel 72 among several slot-shaped output channels, and flows in the direction of the multiple slot-shaped output orifices at the lower end of the nozzle unit 8, to be emitted by the latter and applied to the moving substrate 1.

The substrate can be a thin film of plastic which is guided by a number of rollers. In FIG. 1 the substrate lies essentially in a flat plane, and is in contact with the contact area 74, or to be more exact, with a part of the curved section of the contact area 74. Tests have shown that with the curved section of the contact area 74, diverging relative to the substrate 1, optimal guidance and positioning of the substrate 1 relative to the output orifice is realized. The break-off edge 76 behind the output orifice in the direction of motion of the substrate guarantees that there is no accumulation of material between the mouthpiece holder 68 and the substrate 1. Without the edge 76, any such accumulation of material could break loose and produce an uneven application of material. In the example versions the nozzle unit 8 is implemented as a slotted nozzle unit for wide area application; it could just as well be implemented as a nozzle unit with output orifices of different shapes.

By means of the control unit 77 the application heads can be controlled in such a way that material is applied to the substrate continuously or discontinuously and intermittently. Through appropriate control of the pressurized air, the valve body 14 can be opened and closed around 1200 times a minute.

In intermittent operation pressurized air is applied to the piston 18 through the lines 10, 11, 90, 92. The air can be supplied at varying pressures in the chambers 26 and 28. In the open position of the valve body 14 the piston 18 is pushed into the position shown in FIG. 2 by a force operating downward in the direction of the substrate 1. This is done by opening the solenoid valve 12 (FIG. 1) so that pressurized air operates on the piston 18. Since the effective area 34 is larger than the effective area 36, the piston moves in the downward, downstream direction of the substrate 1. If the pressure toward the pressurized air in the chamber 26 is reduced in comparison to the earlier state, by activating a solenoid valve, then on the one hand there is the force of the spring 32 operating upward on the piston 18, and at the same time a force is created in the same direction whose magnitude can be calculated essentially as the product of the pressure and the effective surface area 36. The piston 18 now moves upward together with the shaft segment 16, so that the valve body 14 is moved in the upward, upstream direction of the valve seat 44 (FIGS. 2 and 3) until it is in contact with the valve seat 44, as shown in FIG. 3.

Because the valve body 14 is movable, it operates within the cylindrical chamber 56 during the closing movement in the manner of a piston located within a cylinder, and brings about a reduction in pressure in the cylindrical chamber 56. Furthermore there is adhesive adhering to the top surface of the valve body 14, so that the adhering material is "carried along" upward together with the valve body 14 which is moving upward against the flow of the material during application of the material.

Due to the movement of the valve body 14 in the upstream direction during closing, there is a (slight) backflow counter to the direction of flow during application of material inside the supply channel 46, the cylindrical chamber 56, the passage 58 and the output channels, as indicated in FIG. 3 by the arrows, so that because of this backflow, during the closing movement the outflow of material through the output orifices and the application to the substrate 1 is interrupted abruptly, so that an application pattern with sharp lines of delimitation can be applied to the substrate without significant run-on zones. A movement of the valve body 14 in the downstream direction toward the opening position causes material to be pushed in the direction of the passage 58 by the valve body.

In the devices shown in FIGS. 5–8, due to the fact that in each case there are two application heads 78, 80, 94, 96 feeding material to a nozzle unit, the valve mechanisms for the two application heads can be controlled by means of the control unit in such a way that the valve mechanisms alternately open or close the supply channel to the flow of material, so that an application pattern can be achieved on the substrate, depending on a specified speed of the substrate 1, such that there are very small intervals between individual application zones and narrow widths of the application zones. This may be desired, for example, if the substrate, which is in one piece during the application, is later to be separated into a number of pieces, each of which has a defined zone with material applied.

Alternatively, the device can be switched by means of the control unit in such a way that both application heads have open valve mechanisms simultaneously, so that material is conveyed though both supply channels to the output orifices (or a single output orifice) and applied. If one of the two valve mechanisms is brought to the closed position, in which the flow of material through the supply channel is interrupted, while the other valve mechanism remains in the open position, then less material is delivered through the output orifice (or orifices) than in the operating state in which both valve mechanisms are in the open position. If one valve mechanism is operated continuously and the other intermittently, then it is possible to apply a pattern to the substrate 1 which exhibits zones of lighter and heavier application to the substrate.

While the present invention has been illustrated by a description of various embodiments and while these embodiments have been described in considerable detail, it is not the intention of the Applicants to restrict or in any way limit the scope of the appended claims to such detail. Additional advantages and modifications will readily appear to those skilled in the art. The invention in its broader aspects is therefore not limited to the specific details, representative apparatus and method as shown and described. This has been a description of the present invention, along with the preferred methods of practicing the present invention as currently known. However, the invention itself should only be defined by the appended claims, wherein we claim:

1. An applicator for applying a liquid to a substrate movable with respect thereto and comprising:

a unit having a supply channel for conducting the liquid in a downstream direction;

a valve seat mounted in said supply channel;

a valve body mounted in said supply channel and having a distal end located downstream of said valve seat, said valve body being movable in an upstream direction into contact with said valve seat to stop the flow of liquid through said supply channel, and said valve body being movable in a downstream direction out of contact with said valve seat to permit the flow of the liquid through said supply channel;

a control unit having a piston slidably mounted therein, said piston having first and second sides with different effective areas which are connectable to a source of pressurized air; and a shaft segment having one end connected to the distal end of the valve body and an opposite end connected to the first side of the piston.

2. An applicator of claim 1 wherein said first side of said piston has a smaller effective area than said second side and said piston being capable of moving said valve body in the downstream direction in response to pressurized air being applied to said second side of said piston.

3. An applicator of claim 2 further comprising a spring for providing a biasing force on said piston and moving said valve body toward said valve seat.

4. An applicator for applying a liquid to a substrate movable with respect thereto and comprising:

a unit having a supply channel for conducting the liquid in a downstream direction;

a valve seat mounted in said supply channel;

a valve body mounted in said supply channel and having a distal end located downstream of said valve seat, said valve body being movable in an upstream direction into contact with said valve seat to stop the flow of liquid through said supply channel and said valve body being movable in a downstream direction out of contact with said valve seat to permit a flow of the liquid through said supply channel;

a nozzle unit having a distribution channel in fluid communication with said supply channel, an output orifice for delivering the liquid to the substrate, and a mouthpiece holder and a mouthpiece having an external contact area partially contacting the substrate during application of the liquid, said external contact area extending from said output orifice in a direction opposite to the direction of application of the liquid onto the substrate and having a curved section with an arcuate cross-section diverging relative to the substrate.

5. An applicator of claim 4 wherein said mouthpiece holder comprises a duct intersecting said supply channel and said distribution channel for supplying the liquid therebetween.

6. An applicator of claim 5 wherein said duct has a centerline oblique to a major surface of the substrate.

7. An applicator of claim 6 wherein said centerline of said duct forms an angle of approximately 45° with the major surface of the substrate.

* * * * *

UNITED STATES PATENT AND TRADEMARK OFFICE

CERTIFICATE OF CORRECTION

PATENT NO. : 6,164,568
DATED : December 26, 2000
INVENTOR(S) : Muller et al.

It is certified that error appears in the above-identified patent and that said Letters Patent is hereby corrected as shown below:

Column 6,
Line 51, after "moved in the" insert -- downward --.

Column 9,
Line 63, after "direction", delete "of" and insert therefor -- toward --.
Line 64, after "pressure", delete "toward" and insert therefor -- of --.

Signed and Sealed this

Twenty-fifth Day of December, 2001

*Attest:*

*Attesting Officer*

JAMES E. ROGAN
*Director of the United States Patent and Trademark Office*